US008521802B1

(12) United States Patent
Abuelma'atti

(10) Patent No.: US 8,521,802 B1
(45) Date of Patent: Aug. 27, 2013

(54) ARBITRARY POWER LAW FUNCTION GENERATOR

(71) Applicant: King Fahd University of Petroleum and Minerals, Dhahran (SA)

(72) Inventor: Muhammad Taher Abuelma'atti, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 13/771,060

(22) Filed: Feb. 19, 2013

(51) Int. Cl.
*G06G 7/24* (2006.01)

(52) U.S. Cl.
USPC ..... 708/851

(58) Field of Classification Search
USPC ..... 708/851
See application file for complete search history.

(56) References Cited

U.S. PATENT DOCUMENTS 4,004,141 A * 1/1977 Curtis ..... 708/851
4,385,364 A * 5/1983 Main ..... 708/851
7,310,656 B1 * 12/2007 Gilbert ..... 708/851

OTHER PUBLICATIONS

Abuelma'atti M.T., Abed S.M Translinear circuit for generating arbitrary power-law functions (1998) Microelectronics Journal, 29 (7), pp. 465-470. (abstract only).

* cited by examiner

*Primary Examiner* — Tan V. Mai
(74) *Attorney, Agent, or Firm* — Richard C. Litman

(57) ABSTRACT

The arbitrary power law function generator uses an equal number of exponential and logarithmic circuits, e.g., two exponential and two logarithmic circuits, which are current-mode, current-controlled circuits that provide positive, negative, integer, or non-integer powers independent of temperature. Moreover, the circuit can operate from a DC power supply as low as ±1.5V. SPICE simulation results using practical bipolar junction transistor (BM parameters are included to confirm the feasibility of the function generator.

4 Claims, 6 Drawing Sheets

600

ARBITRARY POWER LAW FUNCTION GENERATOR

BACKGROUND OF THE INVENTION

1. Field of the Invention

The present invention relates to function generators, and particularly to an arbitrary power law function generator using semiconductors operating in a current-mode, and wherein the power law functions generated are current-controlled.

2. Description of the Related Art

Power law function generators are very attractive circuits in analog signal processing. Such circuits have many applications as basic blocks in communication electronic circuits, measurement systems and modeling of the non-linear current-voltage characteristics of many devices. Power-law circuits implemented in voltage mode techniques are usually built around operational amplifiers and diodes, analog multipliers, operational transconductance amplifiers (OTAs), the current differencing transconductance amplifier (CDTA), bipolar transistors, or MOSFETs working in the weak inversion region where the exponential relationship between the drain current and the gate-to-source voltage is exploited to advantage. Among these techniques, the OTA-based circuits are preferred due to their programmability and modularity. However, such realizations either depend on approximations of the power law function, or are temperature dependent and silicon intensive, as it requires a large number of OTAs or else one can realize only one power law function, e.g., the cube-law. Power-law circuits implemented in the transconductance mode, that is, input voltage and output current, have also been reported using a bipolar junction transistor (BJT). In both circuits, the power-law function is a function of the thermal voltage, and hence is temperature sensitive.

Due to the many benefits it has, current-mode implementation of power law circuits have also been reported. These circuits are true power-law realizations with temperature independent characteristics. The problem with existing current-mirror power law implementations is the staking nature of the BJTs used as diodes to get the required power law, restricting such circuits to operation with relatively high voltage power supplies. Moreover, the power factor can be adjusted either by controlling the gain of an operational amplifier-based voltage amplifier, the ratio of a resistors-based potentiometer, or the number of p-n junction diodes. Current-mode power law function generator circuits based on a transconductor, a square-root function generator, a cube-root function generator and a weighting transimpedance amplifier can provide power factors between ½ and ⅓ only. Other existing circuits can realize a function of the form $i_o=i_y(i_x/i_z)^m$ and use a logarithmic function generation, an exponential function generator, and a voltage amplifier and can realize power factor values over a continuous range. However, the power factor m is controlled by adjusting the gain of a voltage amplifier.

Yet other circuits are built around two logarithmic circuits and a single exponential circuit, and can realize the function $i_o=i_y(i_x/i_z)^m$. However, the power factor m is controlled by connecting an external resistance to control the gain of an operational-amplifier-based voltage amplifier or by connecting an external voltage divider. Such circuits do not enjoy the attractive property of current-controlled power factor, and therefore cannot be described as current-controlled current-mode power-law function generators.

Thus, an arbitrary power law function generator solving the aforementioned problems is desired.

SUMMARY OF THE INVENTION

The arbitrary power law function generator uses two exponential and two logarithmic current-mode, current-controlled circuits, which provide positive, negative, integer, or non-integer powers independent of temperature. Moreover, the circuit can operate from a DC power supply having a voltage as low as ±1.5V. SPICE simulation results using practical bipolar junction transistor (BJT) parameters are included to confirm the feasibility of the proposed design approach.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The arbitrary power law function generator uses semiconductors operating in current-mode, and wherein the power law functions generated are current-controlled. The function generator uses an equal number of exponential and logarithmic circuits, e.g., two exponential and two logarithmic circuits, which provide positive, negative, integer, or non-integer powers independent of temperature. By "arbitrary", it is meant that the function generator is not limited to one or two discrete powers, but is capable of generating functions to any desired power, whether positive or negative, and whether an integer power or a fractional power. Moreover, the function generator can operate from a DC power supply having a voltage as low as ±1.5V. SPICE simulation results using practical bipolar junction transistor (BJT) parameters are included to confirm the feasibility of the function generator.

Figure 1:
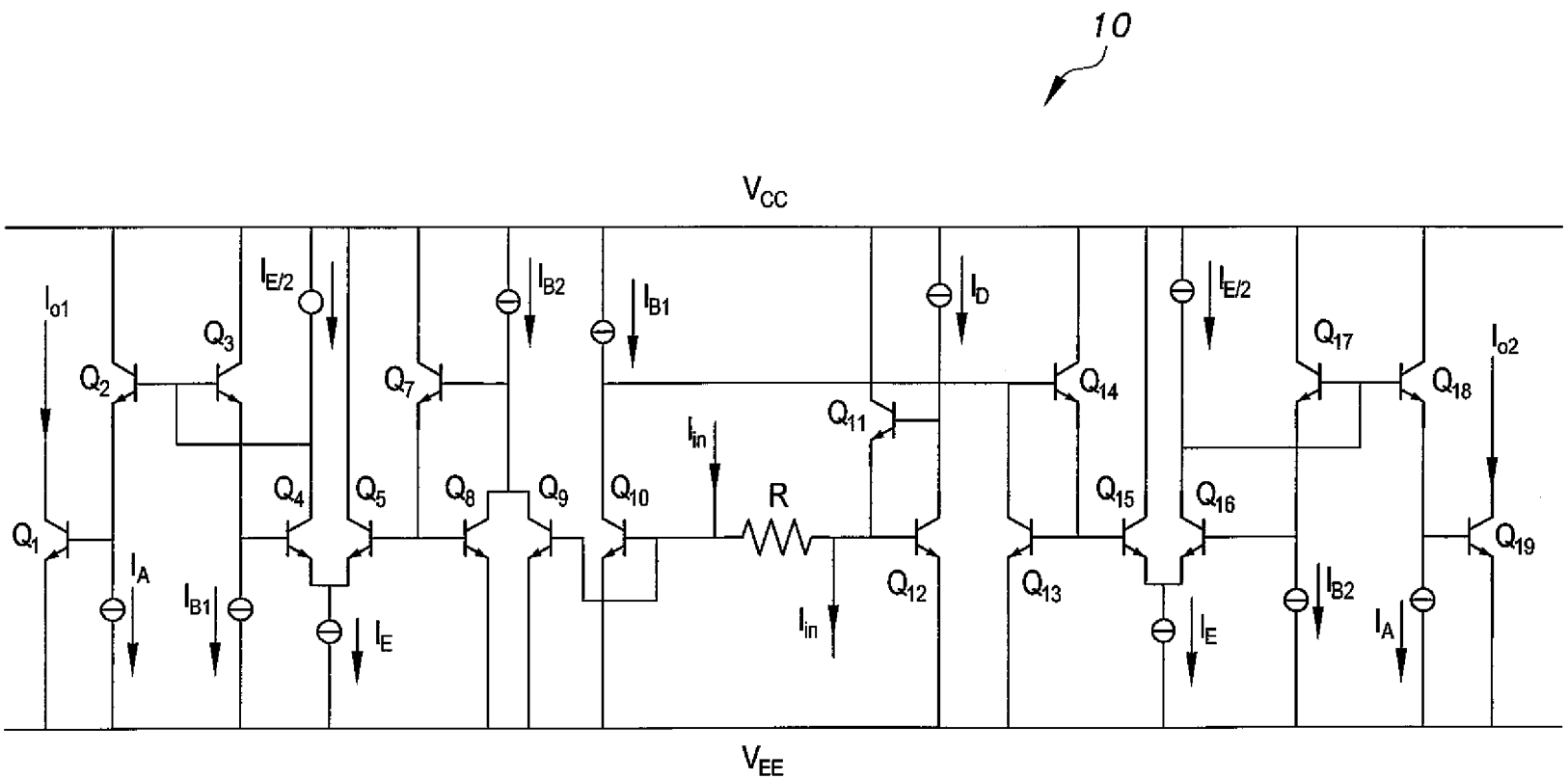
FIG. 1 is a schematic diagram of an active exponential circuit having current mirrors that can be used in an arbitrary power law function generator according to the present invention.

An exponential circuit 10 that can be used in the function generator is shown in FIG. 1. Note that transistors $Q_7$, $Q_{11}$ and $Q_{14}$ are providing biasing currents to transistors $Q_5$ and $Q_8$ $Q_{12}$, and $Q_{13}$ and $Q_{15}$, respectively. Assuming identical transistors with negligible base currents and the same value of the saturation current, $I_s$, and applying KVL (Kirchhoff's voltage law) on the loop formed of $Q_{10}$, R and $Q_{12}$, results in the relation:

$$V_{BE10}=I_{in}R+V_{BE12} \quad (1)$$

Equation (1) can be rewritten as:

$$I_{C13} = I_{B1} - I_D \exp\left(\frac{I_{in}R}{V_T}\right). \quad (2)$$

In deriving equation (2), use is made of the relationship of equation (3) between the base-to-emitter voltage and the collector current.

$$V_{BEi} = V_T \ln\left(\frac{I_{Ci}}{I_s}\right) \quad (3)$$

In a similar way, applying KVL on the loop formed of $Q_9$, R and $Q_{12}$, yields:

$$I_{C8} = I_{B2} - I_D \exp\left(\frac{I_{in}R}{V_T}\right). \quad (4)$$

Applying the translinear principle (TLP) to the loop formed of $Q_{13}$, $Q_{15}$-$Q_{19}$ yields:

$$I_{C13}\frac{I_E}{2} I_{B2} = I_A \frac{I_E}{2} I_{o2}. \quad (5)$$

Combining equations (2) and (5) yields:

$$I_{o2} = \frac{I_{B2}}{I_A}\left(I_{B1} - I_D \exp\left(\frac{I_{in}R}{V_T}\right)\right). \quad (6)$$

In a similar way, applying the TLP to the loop formed of $Q_1$-$Q_5$, $Q_8$ and following same steps, yields:

$$I_{o1} = \frac{I_{B1}}{I_A}\left(I_{B2} - I_D \exp\left(\frac{I_{in}R}{V_T}\right)\right). \quad (7)$$

Combining equations (6) and (7) results in:

$$I_o = I_{o1} - I_{o2} = \frac{I_D}{I_A}(I_{B2} - I_{B1})\exp\left(\frac{I_{in}R}{V_T}\right). \quad (8)$$

Equation (8) is the desired exponential function, where $I_o = I_{o1} - I_{o2}$ represents the output current, and $I_A$, $I_{B1}$, $I_{B2}$ and $I_D$ act as control currents to adjust the gain and the polarity of the exponential function. An additional current-mirror based current subtraction circuit is needed to obtain the output current $I_o$. This is implemented using standard current mirrors.

Figure 2:
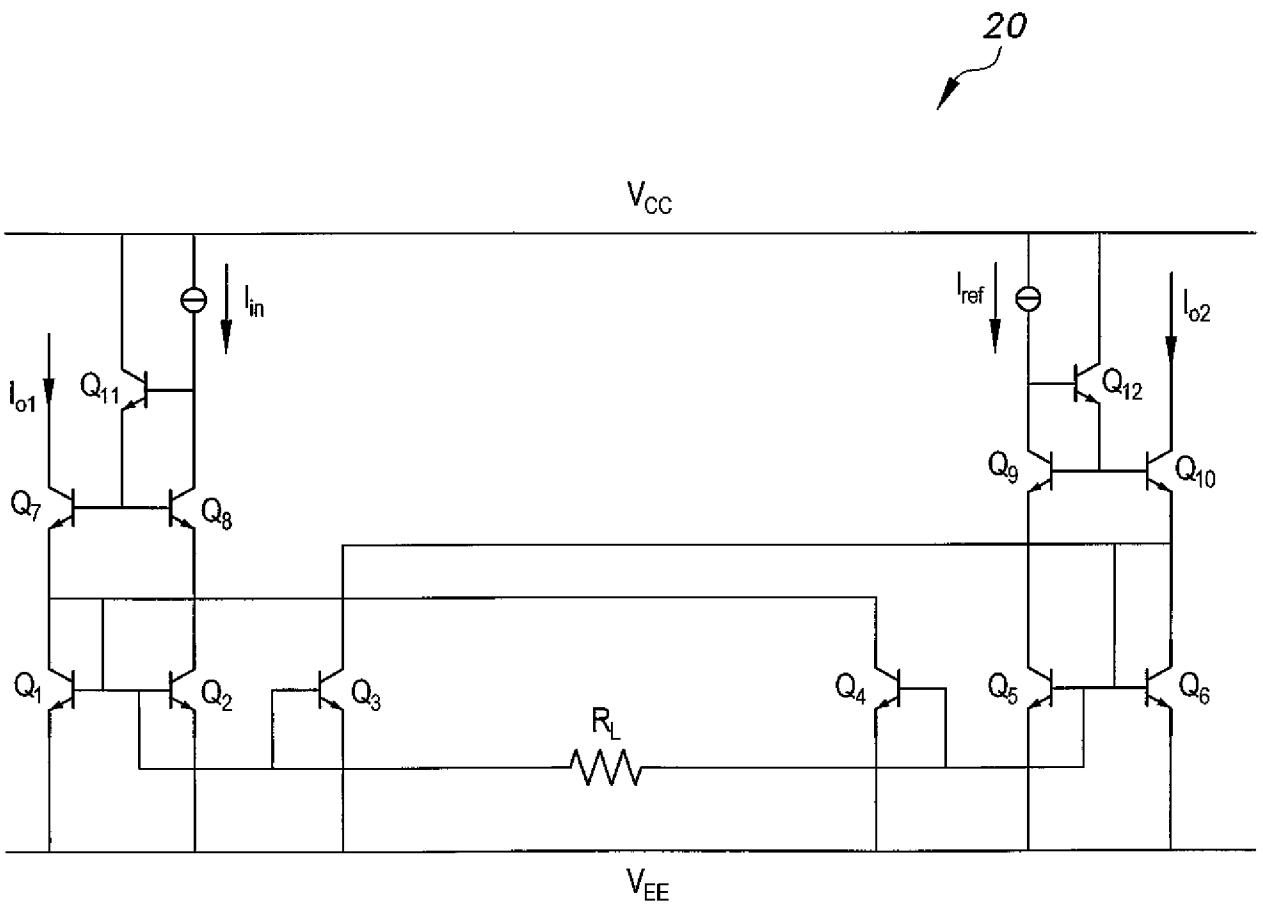
FIG. 2 is a schematic diagram of an active natural logarithmic circuit having current mirrors that can be used in an arbitrary power law function generator according to the present invention.

In the present logarithmic circuit 20, shown in FIG. 2, applying KCL (Kirchhoff's current law) at the emitter of $Q_7$ yields:

$$I_{o1} = I_{in} + I_{ref} + I_{R_L}, \quad (9)$$

where $I_{R_L}$ is the current through the resistance $R_L$. Similarly, applying KCL at the emitter of $Q_{10}$ yields:

$$I_{o2} = I_{in} + I_{ref} - I_{R_L}. \quad (10)$$

Applying KVL to the loop formed of $Q_3$, $R_L$ and $Q_4$ yields:

$$I_{R_L}R_L = V_{BE3} - V_{BE4}. \quad (11)$$

Assuming identical transistors, equation (11) yields:

$$I_{R_L} = \frac{V_T}{R_L}\ln\left(\frac{I_{in}}{I_{ref}}\right). \quad (12)$$

Combining equations (9), (10) and (12) yields:

$$I_o = I_{o1} - I_{o2} = 2\frac{V_T}{R_L}\ln\left(\frac{I_{in}}{I_{ref}}\right). \quad (13)$$

Equation (13) is the desired logarithmic function, where $I_o = I_{o1} - I_{o2}$ represents the output current, and $I_{ref}$ acts as the control current. The gain of the logarithmic function is controlled by the resistance $R_L$. An additional current-mirror-based current subtraction circuit is needed to obtain the output current $I_0$. This is implemented using standard current mirrors.

Inspection of equations (8) and (13) clearly shows that the output currents of the exponential and logarithmic circuits are dependent on the temperature through the thermal voltage $V_T$. However, in power law function generation using an equal number of exponential and logarithmic circuits, the final output current will be independent of temperature.

Figure 3:
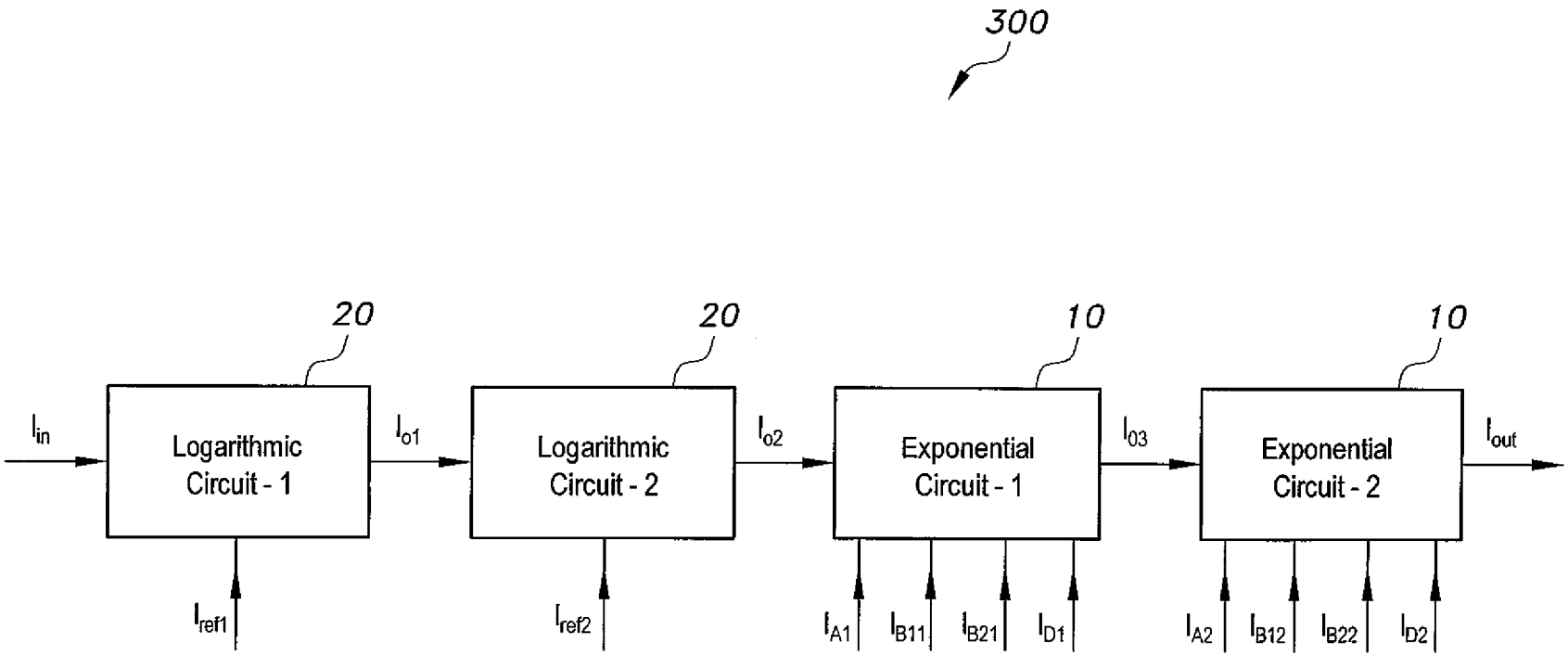
FIG. 3 is a block diagram of an exemplary embodiment of an arbitrary power law function generator according to the present invention.

With respect to the power law function generator, the general form of the power law function can be written as $$y = A\left(\frac{x}{B}\right)^{\frac{C}{D}}, \quad (14)$$

where A, B, C and D are constants. The proposed realization of the single-ended input and differential output current-mode current-controlled power-law function generator is shown in FIG. 3. This single-ended input and differential output current-mode current-controlled power-law function generator 300 includes four cascaded blocks. The first two are logarithmic circuits 20 and the others are exponential circuits 10. The output current of the first logarithmic circuit, $I_{o1}$, will be given by equation (13). Taking the output of the first logarithmic circuit as the input of the second one, which is also logarithmic, the output current of the second-logarithmic circuit, $I_{o2}$, can be expressed as:

$$I_{o_2} = \frac{2V_T}{R_L}\ln\left[\frac{\frac{2V_T}{R_L}\ln\frac{I_{in}}{I_{ref_1}}}{I_{ref_2}}\right]. \quad (15)$$

Equation (15) can be rewritten as:

$$I_{o_2} = \frac{2V_T}{R_L}\ln\left[\ln\left(\frac{I_{in}}{I_{ref_1}}\right)^{\frac{2V_T}{I_{ref_2}R_L}}\right]. \quad (16)$$

Taking $I_{o_2}$ as the input to the third block, which is configured as an exponential circuit, the output current of the first exponential circuit, $I_{o3}$, can be expressed as:

$$I_{o3} = \frac{I_{D_1}(I_{B_{21}} - I_{B_{11}})}{I_{A_1}}\left[\ln\left(\frac{I_{in}}{I_{ref_1}}\right)^{\frac{2V_T}{I_{ref_2}R_L}}\right] \tag{17}$$

In deriving equation (17), it is assumed that $R_L$=2R. Equation (17) can be rewritten as:

$$I_{o3} = (I_{B_{21}} - I_{B_{11}})\ln\left[\left(\frac{I_{in}}{I_{ref_1}}\right)^{\frac{I_{D1}}{I_{A_1}}\frac{2V_T}{I_{ref_2}R_L}}\right]. \tag{18}$$

The resulting output current of the last block, $I_{out}$, is:

$$I_{out} = \frac{I_{D_2}(I_{B_{22}} - I_{B_{12}})}{I_{A_2}}\exp\left(\frac{R}{V_T}(I_{B_{21}} - I_{B_{11}})\ln\left[\left(\frac{I_{in}}{I_{ref_1}}\right)^{\frac{I_{D1}}{I_{A_1}}\frac{2V_T}{I_{ref_2}R_L}}\right]\right). \tag{19}$$

Equation (19) can be rewritten as:

$$I_{out} = \frac{I_{D_2}(I_{B_{22}} - I_{B_{12}})}{I_{A_2}}\left(\frac{I_{in}}{I_{ref_1}}\right)^m, \tag{20}$$

where $$m = \frac{I_{D_1}}{I_{A_1}}\frac{I_{B_{21}} - I_{B_{11}}}{I_{ref_2}}.$$

Again, in deriving equation (20), it is assumed that $R_L$=2R, and thus m can be a positive number, a negative number, an integer, or a non-integer number.

Comparing equations (14) and (20) shows that all constants, A, B, C and D, are represented by programmable bias currents. It is worth noting here that although the exponential and logarithmic circuits by themselves have temperature dependent characteristics, the net result is temperature independent. This temperature-independent characteristic can be achieved in all applications requiring an equal number of logarithmic and exponential blocks in the signal path. Moreover, while the current sources representing the power law are unidirectional, the power-law function realization of FIG. 3 is not limited to positive output currents only or positive powers only. Negative outputs and negative powers can be obtained by proper selection of the currents $I_{B_{11}}$, $I_{B_{12}}$, $I_{B_{21}}$ and $I_{B_{22}}$.

Regarding mismatch analysis, the proposed exponential circuit of FIG. 1, uses a number of current sources. The analysis presented above assumed ideal matching conditions between these current sources. The effect of mismatch between these current sources on circuit performance is considered. Re-analysis of the TLPs formed of $Q_{13}$, $Q_{15}$-$Q_{19}$ and $Q_1$, $Q_5$-$Q_8$, assuming that the current sources $I_E/2$ changed to $I_E/2+\delta$, yields:

$$I_{o2} = \frac{I_E/2+\delta}{I_E/2-\delta}\frac{I_{B2}}{I_A}\left(I_{B1} - I_D\exp\left(\frac{I_{in}R}{V_T}\right)\right), \tag{21}$$

and $$I_{o1} = \frac{I_E/2+\delta}{I_E/2-\delta}\frac{I_{B1}}{I_A}\left(I_{B2} - I_D\exp\left(\frac{I_{in}R}{V_T}\right)\right). \tag{22}$$

Combining equations (21) and (22), yields:

$$I_o = I_{o1} - I_{o2} = \frac{I_E/2+\delta}{I_E/2-\delta}\frac{I_D}{I_A}(I_{B2} - I_{B1})\exp\left(\frac{I_{in}R}{V_T}\right). \tag{23}$$

Inspection of equations (8) and (23) clearly shows that the effect of the mismatch in the currents $I_E/2$ will not affect the exponential relationship between the input current and the output current. However, it will affect the magnitude of the output current. In a similar way, assuming that the current $I_{B1}$ involved in the loop formed of $Q_{10}$, R and $Q_{12}$ changed to $I_{B1}+\delta$, then equation (2) reduces to:

$$I_{C13} = (I_{B1}+\delta) - I_D\exp\left(\frac{I_{in1}R}{V_T}\right). \tag{24}$$

Also, assuming that the current $I_{B2}$ involved in the loop formed of $Q_{13}$, $Q_{15}$-$Q_{19}$ changed to $I_{B2}+\epsilon$, then equation (5) reduces to:

$$I_{C13}\frac{I_E}{2}(I_{B2}+\varepsilon) = I_A\frac{I_E}{2}I_{o2}. \tag{25}$$

Combining equations (24) and (25) yields:

$$I_{o2} = \frac{I_{B2}+\varepsilon}{I_A}\left(I_{B1}+\delta - I_D\exp\left(\frac{I_{in}R}{V_T}\right)\right). \tag{26}$$

In a similar way, equation (7) reduces to $$I_{o1} = \frac{I_{B1}+\delta}{I_A}\left(I_{B2}+\epsilon - I_D\exp\left(\frac{I_{in}R}{V_T}\right)\right). \tag{27}$$

Combining equations (26) and (27) then:

$$I_{o1} - I_{o2} = \frac{I_D}{I_A}(I_{B2} - I_{B1} - \delta + \varepsilon)\exp\left(\frac{I_{in}R}{V_T}\right). \tag{28}$$

Inspection of equation (28) clearly shows that the exponential relationship between the output current and the input current will be very slightly affected by a scaling factor.

Finally, assuming that the current $I_A$ in the TLP formed of $Q_{13}$, $Q_{15}$-$Q_{19}$ changes to $I_A+\delta$, then equations (6) and (7) reduce to:

$$I_{o2} = \frac{I_{B2}}{I_A+\delta}\left(I_{B1} - I_D\exp\left(\frac{I_{in}R}{V_T}\right)\right) = \frac{I_{B2}}{I_A}\left(1-\frac{\delta}{I_A}\right)\left(I_{B1} - I_D\exp\left(\frac{I_{in}R}{V_T}\right)\right), \tag{29}$$

$$I_{o1} = \frac{I_{B1}}{I_A + \delta}\left(I_{B2} - I_D\exp\left(\frac{I_{in}R}{V_T}\right)\right) = \frac{I_{B1}}{I_A}\left(1 - \frac{\delta}{I_A}\right)\left(I_{B2} - I_D\exp\left(\frac{I_{in}R}{V_T}\right)\right). \quad (30)$$

Combining equations (29) and (30), results in:

$$I_{o1} - I_{o2} = \frac{I_{B1} - I_{B2}}{I_A}\left(1 - \frac{\delta}{I_A}\right)\left(I_D\exp\left(\frac{I_{in}R}{V_T}\right)\right). \quad (31)$$

Inspection of equation (31) clearly shows that the exponential relationship between the output current and the input current will be slightly affected by a scaling factor.

To verify the performance of the present current-mode current-controlled power law function generator, the configuration of FIG. 3 was simulated using SPICE circuit simulation program, the circuits of FIGS. 1 and 2, and the real BJT transistor parameters shown in Table 1.

TABLE 1

| Practical (Real) Transistor Parameters (BFP640 Infineon ) | | |
|---|---|---|
| IS = .22F | AF = 2 | KF = 72.91P |
| VAF = 1000 | BF = 450 | NF = 1.025 |
| NE = 2 | IKF = .15 | ISE = 21F |
| VAR = 2 | BR = 55 | NR = 1 |
| NC = 1.8 | IKR = 3.8M | ISC = 400F |
| RBM = 2.707 | RB = 3.129 | IRB = 1.522M |
| CJE = 227.6F | RE = .6 | RC = 3.061 |
| TF = 1.8P | VJE = .8 | MJE = 0.3 |
| ITF = 0.4 | XTF = 10 | VTF = 1.5 |
| VJC = 0.6 | MJC = .5 | CJC = 67.43F |
| TR = .2N | CJS = 93.4F | XCJC = 1 |
| MJS = .27 | NK = −1.42 | VJS = .6 |
| XTI = 3 | FC = .8 | EG = 1.078 |

Figure 4:
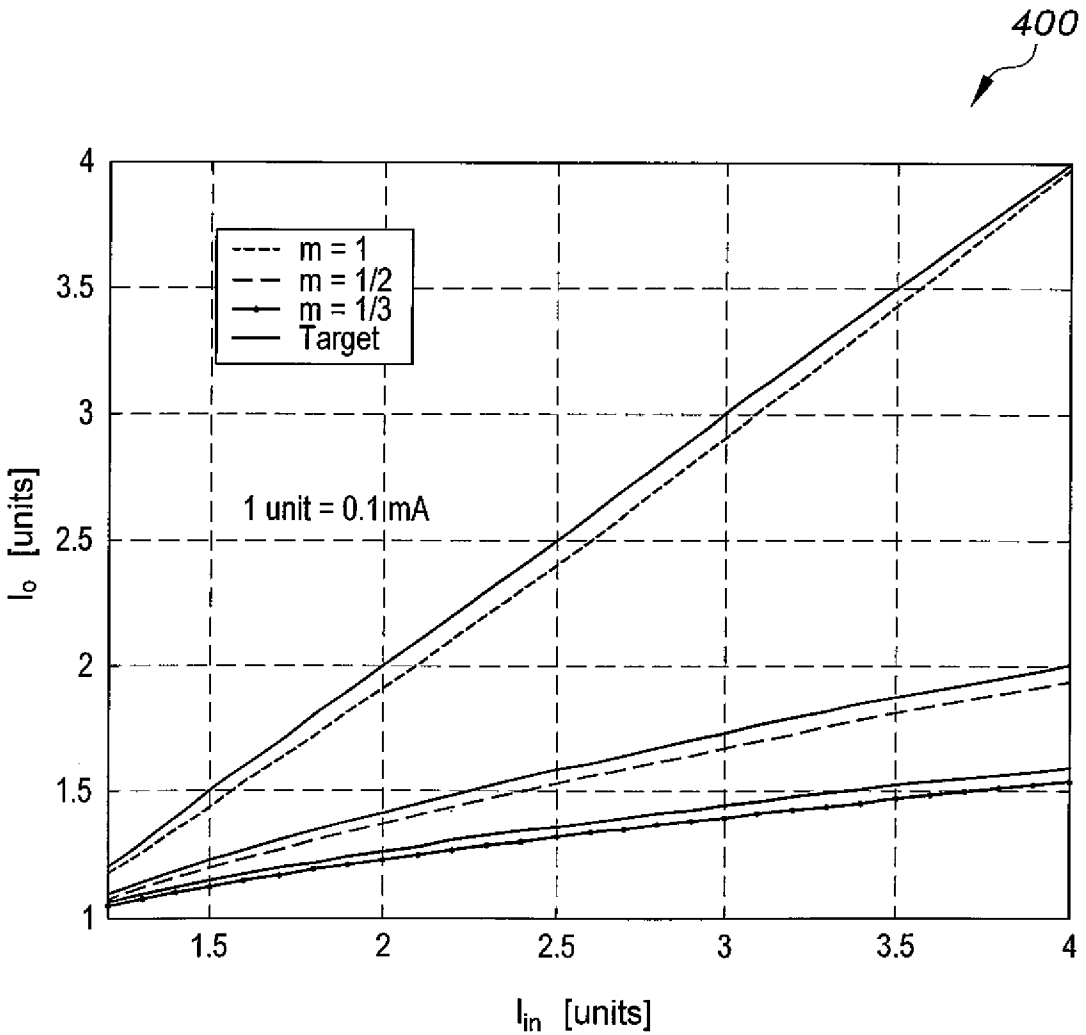
FIG. 4 is a plot illustrating performance for different values of the power factor m in an arbitrary power law function generator according to the present invention.
Figure 5:
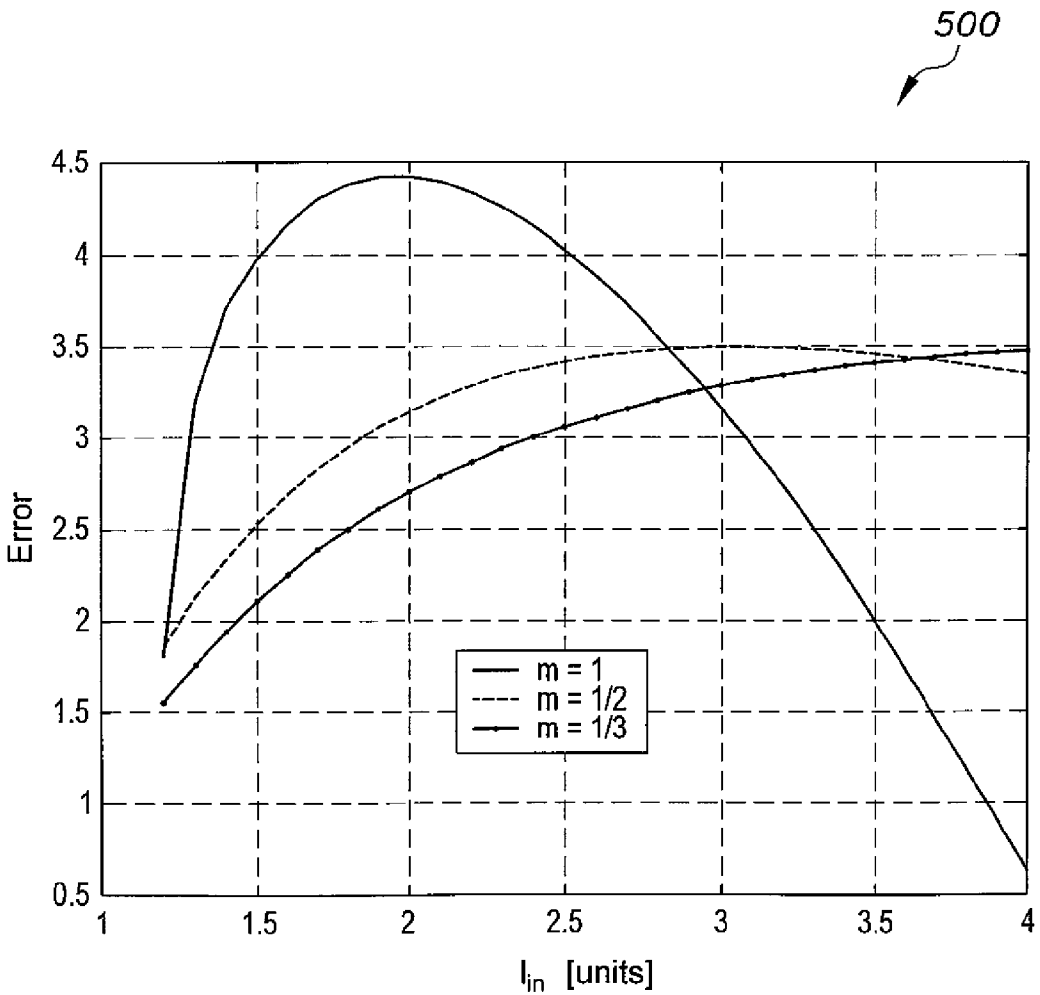
FIG. 5 is a plot illustrating percentage error in the simulation results of FIG. 4.

FIGS. 4 and 5 show the simulation results for different power-law values less than or equal to one. In these simulations, the values of the resistors appearing in the logarithmic function and the exponential function are chosen so that all currents are normalized and measured in units of 0.1 mA. Inspection of plot 400 of FIG. 4 shows that an input dynamic range of 4 units is achieved. Plot 500 of FIG. 5 shows the percentage error between the simulation results of FIG. 4 and calculated results. Inspection of FIG. 5 shows that the percentage error is less than 4.5% in its worst case.

Figure 6:
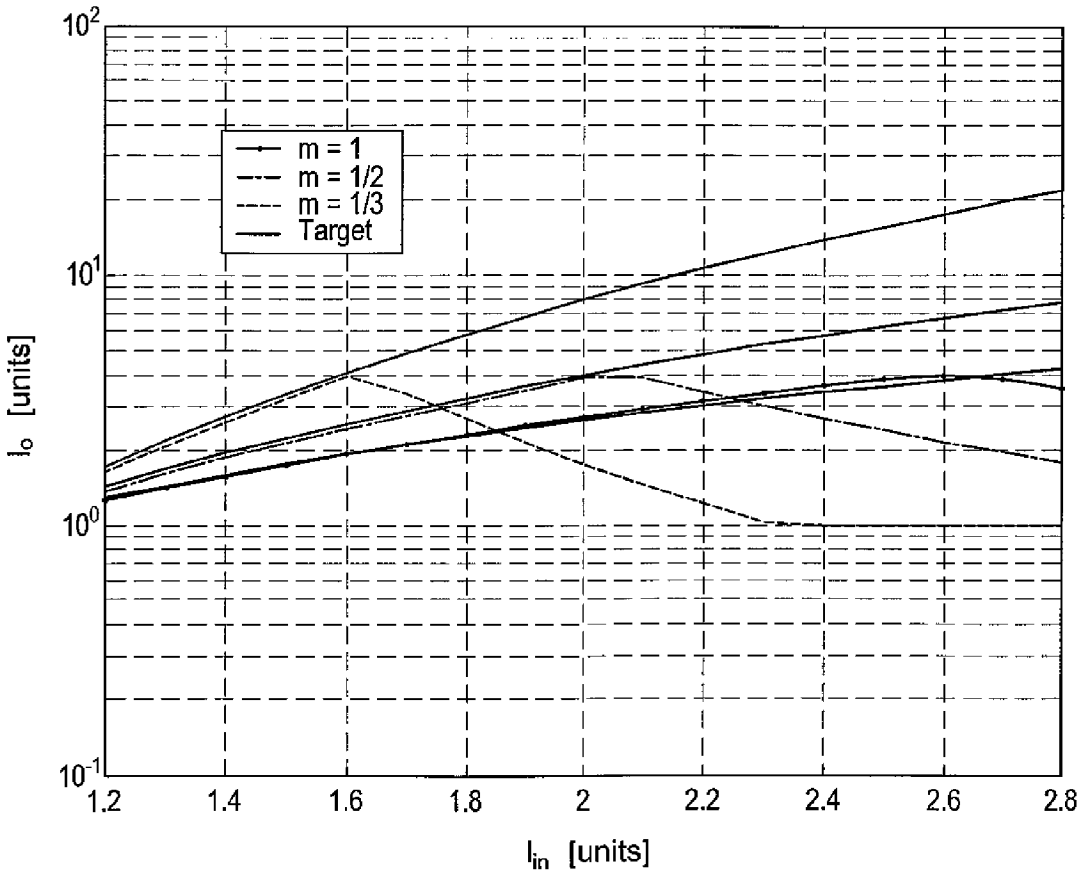
FIG. 6 is a plot illustrating simulation results for an arbitrary power law function generator according to the present invention for a power factor in greater than 1.

Plot 600 of FIG. 6 shows simulation results for power-factors larger than one. Inspection of FIG. 6 shows that the input dynamic range is lower than that for powers less than or equal to 1. This is due to the relatively large resultant common-mode currents at the output of the final exponential block. In order to partially solve this problem and to increase the input dynamic range, the currents can be shifted down to be normalized at 10uA, rather than 100uA. This suggests that the values of the resistors used in the circuits of FIGS. 1 and 2 be 10 times larger. However, deriving the BJTs for operation at lower biasing levels will impose limits on the usable bandwidth of the circuit. These simulation results clearly show the feasibility of using the exponential and logarithmic circuits of FIGS. 1 and 2 in designing temperature-insensitive current-controlled current-mode arbitrary power law functions with integer and non-integer powers.

The simulation results were obtained assuming perfectly matched transistors and resistors. While it is impossible to have perfectly matched transistors in practice, it is possible using the common-centroid, inter-digitization, and cross-connected quads layout techniques to achieve nearly matched transistors and resistors. Moreover, from equation (20), it appears that the practical realization of the present circuit requires a number of temperature-independent current-sources, which are readily available.

A truly current-mode, with input current and output current, current-controlled temperature-insensitive arbitrary power law function generator has been presented. The present circuit can operate from a DC supply voltage as low as ±1.5V. Moreover, it can provide arbitrary positive, negative, integer or non-integer powers by proper selection of the control currents. Furthermore, since all the operation is in current-mode, then addition or subtraction of currents is straight forward and may require only additional current mirrors. This paves the way to synthesizing Taylor series functions for emulating any nonlinear function, and may prove very useful in analog signal processing. Moreover, it is worth mentioning here that the proposed circuits shown in FIGS. 1 and 2 can be modified to form the basic building blocks of Configurable Analog Blocks (CABs) used in Field Programmable Analog Arrays.

As the present realizations are based on the TLP with BJTs in the active mode, one main factor affecting the accuracy and bandwidth of these circuits is the base currents. In order to partially solve this problem, BJTs with larger DC current gain can be used. However, this may not be possible when using transistors with higher cutoff frequency. On the other hand, replacing the BJTs by MOSFETs working in the sub-threshold region would provide the same results but with much reduced gate currents, thus improving the accuracy of the proposed realizations.

It is to be understood that the present invention is not limited to the embodiments described above, but encompasses any and all embodiments within the scope of the following claims.

I claim:

1. An arbitrary power law function generator, comprising a series cascade having n logarithmic function blocks feeding a series cascade of n exponential function blocks, n being a user selectable number of the function blocks, wherein:

each of the exponential function blocks has a current-controlled exponential function-generating electronic transistor circuit having a first current input, a first current mirror, and a first current output, the circuit having a first transfer function relating the first current output to the first current input according to an equation characterized by the relation:

$$I_o = I_{o1} - I_{o2} = \frac{I_D}{I_A}(I_{B2} - I_{B1})\exp\left(\frac{I_{in}R}{V_T}\right),$$

where the first output current, $I_o = I_{o1} - I_{o2}$, $I_A$, $I_{B1}$, $I_{B2}$ and $I_D$ are control currents adjusting gain and polarity of the exponential function, and R is an input resistance feeding the first current mirror; and each of the logarithmic function blocks has a current-controlled logarithmic function-generating electronic transistor circuit having a second current input, a second current mirror, and a second current output, the circuit having a second transfer function relating the second current output to the second current input according to an equation characterized by the relation;

$$I'_o = I'_{o1} - I'_{o2} = \frac{V'_T}{R'_L}\ln\left(\frac{I'_{in}}{I'_{ref}}\right),$$

where the second output current $I'_o = I'_{o1} - I'_{o2}$, represents the output current, $I'_{ref}$ represents a control current, and $R'_L$ is a logarithmic function gain control resistance.

2. The arbitrary power law function generator according to claim 1, wherein the resistance $R'_L$ is twice the resistance R.

3. The arbitrary power law function generator according to claim 2, wherein n=2, so that two said logarithmic function blocks feed two said exponential function blocks.

4. The arbitrary power law function generator according to claim 3, wherein the arbitrary power law function generator has a transfer function characterized by the relation;

$$I_{out} = \frac{I_{D_2}(I_{B_{22}} - I_{B_{12}})}{I_{A_2}} \exp\left(\frac{R}{V_T}(I_{B_{21}} - I_{B_{11}}) \ln\left[\left(\frac{I_{in}}{I_{ref_1}}\right)^{\frac{I_{D1}}{I_{A_1}}} I_{ref_2}^{\frac{2V_T}{R_L}}\right]\right),$$

being equivalent to the relation:

$$I_{out} = \frac{I_{D_2}(I_{B_{22}} - I_{B_{12}})}{I_{A_2}} \left(\frac{I_{in}}{I_{ref_1}}\right)^m,$$

where $$m = \frac{I_{D_1}}{I_{A_1}} \frac{I_{B_{21}} - I_{B_{11}}}{I_{ref_2}}, m$$

being capable of taking positive, negative, integer, and non-integer values, the constants $I_{A_2}$, $I_{B_{12}}$, $I_{B_{22}}$, and $I_{D_2}$ being programmable bias currents.

* * * * *